United States Patent [19]

Thayer, III

[11] Patent Number: 4,990,831

[45] Date of Patent: Feb. 5, 1991

[54] SPARK GAP SWITCH SYSTEM WITH CONDENSABLE DIELECTRIC GAS

[75] Inventor: William J. Thayer, III, Kent, Wash.

[73] Assignee: The United States of America as represented by the United States Department of Energy, Washington, D.C.

[21] Appl. No.: 256,839

[22] Filed: Oct. 12, 1988

[51] Int. Cl.[5] ..... H01J 7/24

[52] U.S. Cl. ..... 315/111.01; 315/108; 315/110; 315/112; 315/117; 315/150; 315/326; 315/358; 313/231.01; 313/231.21; 313/570; 313/637

[58] Field of Search ..... 315/50, 111.01, 112, 315/117, 108, 110, 326, 358, 150; 313/570, 637, 231.01, 231.21

[56] References Cited

U.S. PATENT DOCUMENTS

| | | | |
|---|---|---|---|
| 1,821,915 | 9/1931 | Pierce | 315/111.01 |
| 2,094,694 | 10/1937 | Bol et al. | 315/112 |
| 2,104,073 | 1/1938 | Druyvesteyn et al. | 313/637 X |
| 2,265,796 | 12/1941 | Boersch | 313/637 X |
| 2,497,911 | 2/1950 | Reilly et al. | 315/108 X |
| 2,819,427 | 1/1958 | Noskowicz | 315/111.01 |
| 3,376,459 | 4/1968 | Narbus et al. | 313/231 |
| 3,480,829 | 11/1969 | Ornum | 315/111.01 |
| 3,524,101 | 8/1970 | Barbini | 315/150 |
| 3,551,737 | 12/1970 | Sheets | 315/111 |
| 3,671,883 | 6/1972 | Smars | 313/231.01 X |
| 3,688,155 | 8/1972 | Johansson et al. | 313/231.01 X |
| 3,760,145 | 9/1973 | Wolf et al. | 313/231.01 X |
| 4,027,187 | 5/1977 | Rabe | 313/217 |
| 4,077,020 | 2/1978 | Anderson et al. | 313/231.01 X |
| 4,132,961 | 1/1979 | Bergman | 331/94.5 PE |
| 4,190,786 | 2/1980 | Kira | 315/358 |
| 4,237,404 | 12/1980 | Limpaecher | 315/111 |
| 4,257,905 | 3/1981 | Christophorou et al. | 252/571 |
| 4,296,003 | 10/1981 | Harrold et al. | 250/570 |
| 4,360,763 | 11/1982 | Gryzinski | 313/231.01 X |
| 4,440,971 | 4/1984 | Harrold | 174/17 GH |
| 4,490,651 | 12/1984 | Taylor et al. | 315/150 |
| 4,563,608 | 11/1986 | Lawson et al. | 313/231.01 X |
| 4,743,807 | 5/1988 | Christophorou et al. | 313/637 X |
| 4,751,428 | 6/1988 | Christophorou et al. | 313/637 |
| 4,792,724 | 12/1988 | Christophorou et al. | 313/637 |

*Primary Examiner*—Eugene R. LaRoche
*Assistant Examiner*—Do H. Yoo
*Attorney, Agent, or Firm*—L. E. Carnahan; Roger S. Gaither; William R. Moser

[57] ABSTRACT

A spark gap switch system is disclosed which is capable of operating at a high pulse rate comprising an insulated switch housing having a purging gas entrance port and a gas exit port, a pair of spaced apart electrodes each having one end thereof within the housing and defining a spark gap therebetween, an easily condensable and preferably low molecular weight insulating gas flowing through the switch housing from the housing, a heat exchanger/condenser for condensing the insulating gas after it exits from the housing, a pump for recirculating the condensed insulating gas as a liquid back to the housing, and a heater exchanger/evaporator to vaporize at least a portion of the condensed insulating gas back into a vapor prior to flowing the insulating gas back into the housing.

21 Claims, 1 Drawing Sheet

SPARK GAP SWITCH SYSTEM WITH CONDENSABLE DIELECTRIC GAS

BACKGROUND OF THE INVENTION

The Government has rights in this invention pursuant to Contract No. DOE-AC03-85SF15930 between the U.S. Department of Energy and Spectra Technology, Inc.

This invention relates to a high pulse rate spark switch system and more particularly to a high pulse rate spark switch system which includes an easily condensable dielectric gas for purging the interelectrode region of the spark gap switch after the spark discharge.

Spark gaps can operate as switches to control the flow of very large electrical currents under very high voltage conditions, e.g., 100 kilovolt (kV). Spark gaps operate to prevent the flow of electrical current in high voltage applications by filling the space between a pair of electrodes with an insulating gas. When current flow is desired, a trigger pulse on an intermediate electrode or some other means is used to change the state of the insulating gas and thus create a more conductive path. The lower resistance locally leads to a rapid breakdown of the insulating gas between the electrodes, which very rapidly produces a low resistance conduction path, i.e., a spark or an arc, through this gas. This conductive gas must recombine and cool to become nonconductive and approximately its initial density or be removed from the inter-electrode region before the spark gap can again act as an open switch to prevent the flow of electricity. Pressure waves must also be controlled to restore the density of the fresh purge gas to the original density.

Natural recombination of electrons and ionized species and chemical recombination of dissociated species occur very quickly and establish equilibrium conditions within the hot residue. Radiation, diffusion, and thermal conduction to the walls or cool gas regions outside of the spark gap occur at modest rates. These transfer processes are sufficient to allow operation at low switching pulse rates without flowing the insulating gas through the spark gap. However, these naturally occurring processes are not fast enough to produce full recovery of the insulating properties of high power switches at higher pulse repetition rates. At switching rates above a few hundred events per second, the hot gas residues from the spark discharge must be purged from the inter-electrode region to provide an insulating region within times that are practical. The conventional approach to designing and operating spark gaps for such repetitively pulsed operation has been to provide a purging flow of insulating gas through the spark region during and between spark events.

Typical of such structure is that shown in Anderson et al U.S. Pat. No. 4,077,020 which discloses a pulsed gas laser apparatus including a spark gap switch wherein the switch enclosure is filled with an inert gas by providing ports for the entrance and exit of such a gas from a suitable source.

Lawson et al U.S. Pat. No. 4,563,608 also shows a high voltage spark gap switch wherein high pressure gas is supplied to the switch through an annular jet nozzle recessed within one of the electrodes. A venturi housing and an exhaust conduit for discharging gas and residue from the housing are disposed within the other electrode. The high pressure gas entering the housing through the inlet conduit and the nozzle traverses the gap between the first and second electrodes and entrains low velocity gas within the housing decreasing the velocity of the high pressure gas supplied to the housing. The venturi disposed within the second electrode recirculates a large volume of the gas to clean and cool the surface of the electrodes.

Rabe U.S. Pat. No. 4,027,187 also teaches that hot gases and discharge products can be removed from the space between the electrodes of a spark gap switch after the passage of the discharge by a supersonic air flow in the discharge region created by fabricating the ends of the electrodes to form a DeLaval nozzle. The supersonic air flow is said to clear the switch to provide a very short grace period.

Gryzinski U.S. Pat. No. 4,360,763 teaches gas density variations between two electrodes which are controlled by directing a gas stream from a pulse gas source into the region between the electrodes. The patentee states that the gas stream entering the inter-electrode area causes in effect the discharges between the electrodes.

Limpaecher U.S. Pat. No. 4,237,404 discusses a high repetition rate high power spark gap switch of the type useful in pulsed lasers, radar systems and pulse-forming networks which is enabled to operate with higher switching speed at high power levels by rapid chemical composition change cyclically made in the spark gap at high frequency with differing standoff voltage capabilities of different compositions produced in the gap in each cycle. The different standoff voltage capabilities are produced by injecting different gases into the spark gap under fluidic switching control which also act to cool the gases in the gap.

Such conventional approaches of using a flow of gas to clear away or purge the discharge gas from the spark gap after the discharge all utilize a steady flow of an insulating gas such as, for example, air, $N_2$, $SF_6$, or $CO_2$ obtained, for example, from compressed gas cylinders or from a gas compressor and recirculation system. However, as the switching rate approaches the kilo-Hertz range and higher, the amount of flow of such insulating gas required to effectively purge the inter-electrode region correspondingly increases.

Mixtures of insulating gases and atomized liquids have also been used as the dielectric fluid for cooling heat-producing members, for example, in a power supply for x-ray equipment, radar, and transformer equipment. Harrold et al U.S. Pat. No. 4,296,003 describes a dielectric fluid composition which comprises a mixture of a gas and an atomized liquid. The gas is selected from one group consisting of electronegative gases, such as $SF_6$, $CCl_2F_2$, $C_2F_6$, $CClF_3$, and $CF_4$, and mixtures thereof; or from another group consisting of electropositive gases, such as $N_2$ and $CO_2$, and mixtures thereof; or even from mixtures of the two groups. The atomized liquid in the mixture is selected from a group of atomized liquids which may be chlorinated liquids, such as tetrachloroethylene ($C_2Cl_4$), or fluorocarbon liquids, such as perfluorodibutyl ether ($C_8F_{16}O$), and mixtures thereof. These gas mixtures and mixtures of gases and atomized liquids are intended to prevent the formation of discharges and arcs, in contrast to spark gap applications where the dielectric gas is to be repetitively broken down in the spark formation process.

Harrold U.S. Pat. No. 4,440,971 describes the same mixture of dielectric fluids wherein the second fluid, instead of being an atomized liquid, is a supersaturated vapor which is mixed with the dielectric gas comprising the first fluid. No atomizing is necessary and the resulting mixture is said to be a substantially droplet-free vaporous dielectric.

Efficient, long life, reliable operation of a spark gap at high pulse repetition rates places many requirements on the spark gap switch design and the dielectric gas used in the switch. Recent studies have shown that the energy dissipated in forming a spark column depends strongly on the molecular weight of the insulating gas. Low molecular weight gases provide more efficient breakdown characteristics than high molecular weight gases, even though the higher molecular weight gases may have better insulating characteristics. In addition, the dielectric gas should be composed of molecular species that do not contain elements that will form solid, conductive products when this gas is decomposed by the spark. Dielectric gases that contain carbon, sulfur, or other conductive materials will cause spark gap switch failure due to deposition of these materials on the switch walls when the dielectric gas is dissociated by the spark, with subsequent surface flashover when high voltage is applied. The very large amounts of energy dissipated in the spark during each pulse, and consequently the large thermal power loads during continuous, high pulse repetition rate operation, create a need for absorbing this energy in the flowing dielectric medium. The specific heat of dielectric gases is sufficiently low and heat transfer rates sufficiently low that a gaseous medium alone is not adequate for heat removal at high pulse rates. The heat of vaporization of the liquid phase of a condensable dielectric gas provides this thermal capacity. An additional consideration in the operation of purged, high pulse rate spark gaps is the power required to circulate the dielectric gas at high pulse rates. At pulse rates above approximately 1000 Hz, the flow circulation power is a significant fraction of the transferred electrical power. At pulse rates above approximately 10 kHz, the flow circulation power for a gas system can be equal to or greater than the transferred electrical power, thus causing a major inefficiency in the spark gap operation. Pumping and recirculation of the condensed phase of an easily condensed dielectric gas can reduce this flow circulation power by approximately 1000 times.

Thus, use of an easily condensable, and preferably low molecular weight dielectric gas can both reduce the direct electrical losses associated with forming the spark and also the power requirements and losses associated with flowing the purge gas through a high pulse rate spark gap. Dielectric media, such as steam or ammonia vapor, which are low molecular weight, condensable at near ambient conditions, and do not decompose to solid products in the high temperatures and severe conditions of the spark, provide unique combinations of properties that make unique approaches to high pulse rate spark gap configuration, operation, and systems possible.

SUMMARY OF THE INVENTION

It is, therefore, an object of this invention to provide a spark gap switch system which uses an easily condensable gas as the insulating gas.

It is another object of this invention to provide a spark gap switch system which uses an easily condensable gas as the insulating gas which is also used for purging the hot gas residues from a high pulse rate spark gap.

It is yet another object of this invention to provide a spark gap switch system which uses, as the insulating gas, an easily condensable gas which, when it dissociates in the spark discharge, forms gaseous products which will not form solid residues on the walls of the spark gap switch housing.

It is a further object of this invention to provide a spark gap switch system which uses, as the insulating gas, a gas which is easily condensed at moderate temperatures, when it is used at a low pressure, to permit recycling of the insulating gas as a liquid back to a vaporizing station in the system.

It is a yet a further object of this invention to provide a spark gap switch system which uses, as the insulating gas, an easily condensable gas selected from the class consisting of steam, ammonia, and halocarbons having the formula $C_mX_nH_i$ where X is fluorine and/or chlorine, m is 1 or 2, n is 1 to 4 when m is 1 and from 1 to 6 when m is 2, and i is the number of hydrogen atoms not displaced by fluorine or chlorine; and mixtures thereof.

It is still another object of this invention to provide a spark gap switch system which uses, as the insulating gas, a low molecular weight gas which is easily condensed at a moderate temperature when it is used at a low pressure.

It is still a further object of this invention to provide a spark gap switch system which uses steam or ammonia vapor as the insulating gas.

These and other objects of the invention will be apparent from the following description and accompanying drawings.

DETAILED DESCRIPTION OF THE INVENTION

Figure 1:
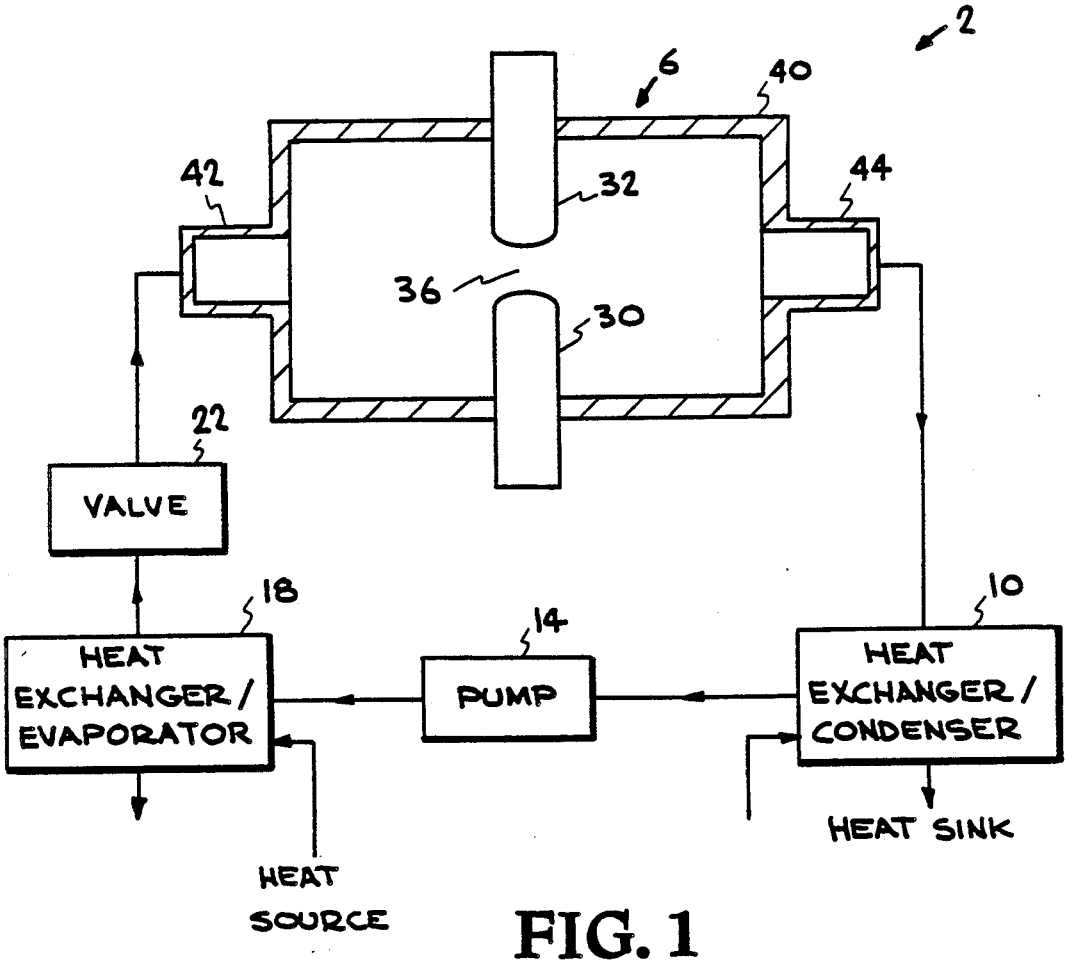
FIG. 1 is a diagrammatic illustration of the spark gap switch system of the invention showing the gas/liquid flow of the easily condensable gas to and from the spark gap switch.

Referring now to FIG. 1, by way of illustration and not of limitation, a spark gap switch system utilizing and recirculating an easily condensable insulating/purging gas in accordance with the invention and capable of operating at a high pulse rate is generally indicated by numeral 2. By high pulse rate is meant a pulse rate of at least about 1 kiloHertz (kHz) and which may be as high as 15 kHz.

Spark gap switch system 2 generally comprises a closed loop system which includes a spark gap switch 6, condensing means 10 to remove heat from and condense the vapors leaving switch 6, pump means 14 to circulate the condensed vapors (liquid) back to switch 6, and vaporization means 18 to vaporize the insulating gas prior to reintroducing it back to switch 6. A flow control valve 22 may also be included in the loop.

Figure 2:
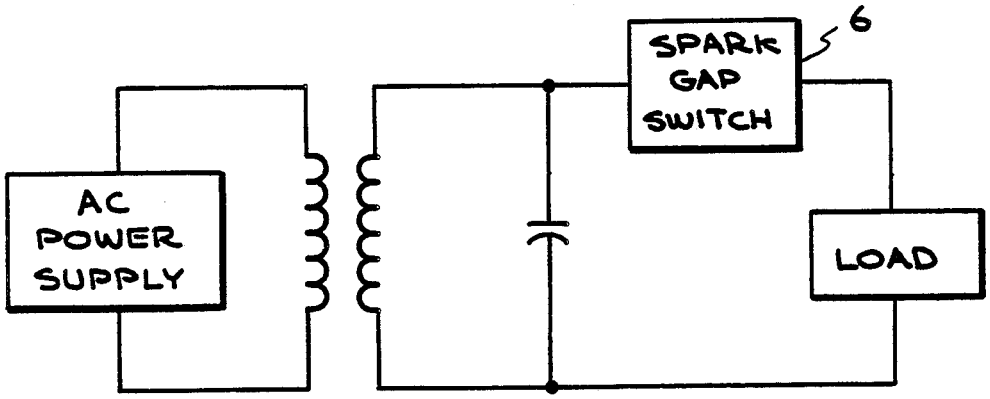
FIG. 2 illustrates a typical electrical schematic utilizing the spark gap switch system of the invention.

FIG. 2 illustrates a typical electrical circuit utilizing spark gap switch system 2 of the invention wherein spark gap switch 6, which may be externally fired via a laser beam (not shown), discharges a capacitor across a load. The hot gas residues resulting from the discharge of the spark between the electrodes are swept away by the flow of easily condensable insulating/purging gases circulating through the system in accordance with the invention.

Referring again to FIG. 1, spark gap switch 6 includes a pair of opposed electrodes 30 and 32 housed in an insulated case 40 at a selected distance apart to create a spark gap 36 therebetween which may vary from as small as 1–2 mm up to about 50 cm or even larger depending upon the insulating gas used, the pressure and temperature of the gas, and the potential between electrodes 30 and 32 which may be from about 10 kV to 10 megavolts or, in some instances, even higher. Typically the spacing of spark gap 36 between electrodes 30 and 32 will be about 3.8 cm when steam is used and the gas pressure in case 40 is maintained at about 1 atmosphere and the potential across electrodes 30 and 32 is about 100 kilovolts.

Case 40 is provided with an entrance port 42 and an exit port 44 through which a source of constantly flowing insulating/purging condensable gas may be flowed through case 40 to purge the hot gas residues which form in the spark gap 36 between electrodes 30 and 32 during the spark discharge.

Still referring to FIG. 1, the easily condensable insulating/purging gas containing the hot gas residues from spark gap 36 leaves case 40 via exit port 44 and flows through condensing means 10 which may comprise a first heat exchanger where the gas or vapor is condensed to a liquid. The liquid emerging from condensing means 10 is then circulated to vaporizing means 18 via pump 14 where the liquid is at least partially vaporized back into a gas, for example, by a second heat exchanger, and this gas is then introduced back into spark gap switch 6 through entrance port 42.

The easily condensable insulating gas of the invention, therefore, preferably comprises an insulating gas which may be condensed/vaporized at moderate temperatures and low pressures since circulation of a liquid by pump 14 requires much less power than using a compressor to circulate a gas.

By the term "moderate temperature" is meant a condensation/vaporization temperature of from about 10° C. up to about 200° C., preferably below about 150° C. By the term "low pressure" is meant a pressure from about 1 to about 10 atmospheres, preferably from about 1 to about 5.0 atmospheres, and most preferably from about 1 to about 2.0 atmospheres.

By the term "easily condensable" is meant a gas which will condense within the specified temperature and pressure ranges.

Examples of such easily condensable gases include steam, ammonia, and steam-ammonia mixtures; 1–2 carbon alkanes such as methane and ethane; one or more fluorinated or chlorinated hydrocarbons or fluorinated/chlorinated hydrocarbons such as the Freons and which have the formula: $C_mX_nH_i$ where X is fluorine and/or chlorine, m is 1 or 2, n is 1 to 4 when m is 1 and from 1 to 6 when m is 2, and i is the number of hydrogen atoms not displaced by fluorine or chlorine; and mixtures thereof.

Examples of such fluorinated/chlorinated hydrocarbons include fluorinated 1–2 carbon hydrocarbons such as $CH_3F$, $CH_2F_2$, $CHF_3$, $CF_4$, $C_2H_5F$, $C_2H_4F_2$, $C_2H_3F_3$, and $C_2H_2F_4$. Examples of chlorinated 1–2 carbon hydrocarbons, for example, include $CH_3C_1$, $CH_2Cl_2$, $CHCl_3$, $CCl_4$, $C_2H_5Cl$, $C_2H_4Cl_2$, $C_2H_3Cl_3$, and $C_2H_2Cl_4$. Examples of the Freons include Freon-11 $CCl_3F$, Freon-12 $CCl_2F_2$, Freon-13 $CClF_3$, Freon-21 $CHCl_2F$, Freon-22 $CHClF_2$, Freon-113 $C_2Cl_3F_3$, Freon-114 $C_2Cl_2F_4$, and Freon-115 $C_2ClF_5$.

Preferably, the easily condensable gas is also a low molecular weight gas. By the term "low molecular weight" is meant a gas having a molecular weight of 20 grams/mole or less. Examples of such easily condensable low molecular weight gases include steam, molecular weight: 18; ammonia, molecular weight: 17; and mixtures thereof; as well as possibly methane, molecular weight: 16.

Preferably, the easily condensable insulating gas will dissociate into gaseous byproducts when the gas is broken down in the spark which forms between the electrodes during the discharge. Of the foregoing gases, methane, ethane, and the halogenated hydrocarbon gases, upon breakdown in the spark, will often form solid, electrically conducting, byproducts, such as carbon, which may coat the wall of the switch casing and cause surface flashover, and therefore, interfere with the long-term operation of the spark gap switch. Thus, steam, ammonia, and steam/ammonia mixtures are the preferred gases of the invention. Of these two gases, steam is the especially preferred gas since the temperature to which ammonia or an ammonia/steam mixture must be cooled at ambient pressure before the ammonia will condense is quite low or the operating pressure must be near of the pressure range, i.e., about 5–10 atmospheres.

Thus, in the operation of the spark gap switch system of the invention, using steam as the insulative/purging gas by way of illustration, steam, at a temperature of about 120° C., enters case 40 of switch 6 through entrance port 42 and flows toward spark gap 36. Upon formation of the spark across gap 36, the flow of steam carries the resulting hot gas residue downstream of the spark gap prior to the next spark where the hot mixture leaves case 40 via exit port 44. The gases flow through condensing means 10 where the steam is cooled to a temperature (equivalent at 1 atmosphere) of below 100° C. and thereby condenses to a liquid, i.e., water. The water emerging from condensing means 10 is then circulated to vaporizing means 18 via pump 14 where the water is again vaporized back into steam, i.e., heated to a temperature (equivalent at 1 atmosphere) of at least 100° C., and then introduced back into the spark gap switch through entrance port 42.

It should be noted that there is no need to excessively heat the steam, since further heat will be imparted to the steam by the liberated energy emitted during the spark firing. In addition, excessive heat is available in the exhaust stream to act as a heat source for vaporizing the liquid phase. However, it may be desirable to provide sufficient heat to the steam to prevent any substantial condensation within switch case 40 for some spark gap configurations.

As an example of a spark gap switch system constructed in accordance with the invention and capable of operating at pulse rates in excess of 1 kHz at a voltage of 60,000 volts, a switch casing was formed from polysulfone material and having a 3.0 centimeter (cm) flow channel height and bore of area of about 16 $cm^2$ which extended 24 cm from a purging gas entrance port at one end of the casing to a purging gas exit port at the opposite end of the casing. A pair of electrodes of 2 cm diameter each had an end located within the casing and spaced apart to define a spark gap therebetween of about 25 millimeters (mm). A purging gas comprising steam at a temperature of 120° C. and a pressure of 14.7 psi required a pulse flow rate through the switch of about 100 liters/second. The spark gap switch was fired only with air simulation at a frequency rate of up to 2400 Hz and at a voltage of 65 kV.

Thus, the invention provides a spark gap switch system utilizing an easily condensable circulating insulating/purging gas resulting in low circulation power consumption, due to the condensing of the gas and its recirculation as a liquid, and providing high efficiency at high pulse rates due to the low molecular weight of the insulating gas and the low circulation power.

While a specific embodiment of an apparatus and easily condensable insulating gas has been illustrated and described for the spark gap switch system of this invention, modifications and changes of the apparatus, parameters, materials, etc. will become apparent to those skilled in the art, and it is intended to cover in the appended claims all such modifications and changes which come within the scope of the invention.

What is claimed is:

1. A spark gap switch system capable of operating at a high pulse rate comprising:
(a) a spark gap switch comprising:
(1) an insulated housing;
(2) a purging gas entrance port in a wall of said housing;
(3) a gas exit port in another wall of said housing; and
(4) a pair of spaced apart electrodes each having one end thereof within said housing and defining a spark gap therebetween;
(b) an easily condensable insulating gas flowing through said switch housing from said entrance port to said exit port to purge hot gases from said housing;
(c) condensing means for condensing said insulating gas after it exits from said housing;
(d) pump means for recirculating said condensed insulating gas as a liquid back to said housing; and
(e) vaporizing means to vaporize at least a portion of said condensed insulating gas back into a vapor prior to flowing said insulating gas back into said housing.

2. The spark gap switch system of claim 1 wherein said easily condensable insulating gas is selected from the class consisting of steam, ammonia, and steam-ammonia mixtures; 1–2 carbon alkanes; one or more halocarbons having the formula $C_mX_nH_i$ where X is fluorine and/or chlorine, m is 1 or 2, n is 1 to 4 when m is 1 and from 1 to 6 when m is 2, and i is the number of hydrogen atoms not displaced by fluorine or chlorine; and mixtures thereof.

3. The spark gap switch system of claim 1 wherein said easily condensable insulating gas is a low molecular weight gas selected from the class consisting of steam, ammonia, methane, and mixtures thereof.

4. The spark gap switch system of claim 1 wherein said easily condensable insulating gas is a low molecular weight gas selected from the class consisting of steam, ammonia, and steam-ammonia mixtures.

5. The spark gap switch system of claim 4 wherein said low molecular weight condensable insulating gas is steam.

6. The spark gap switch system of claim 2 wherein said easily condensable insulating gas is selected from the class consisting of one or more halocarbons having the formula $C_mX_nH_i$ where X is fluorine and/or chlorine, m is 1 or 2, n is 1 to 4 when m is 1 and from 1 to 6 when m is 2, and i is the number of hydrogen atoms not displaced by fluorine or chlorine.

7. The spark gap switch system of claim 2 wherein the pressure in the system is from about 1 to about 10 atmospheres.

8. The spark gap switch system of claim 7 wherein the pressure in the system is from about 1 to about 5 atmospheres.

9. The spark gap switch system of claim 7 wherein the pressure in the system is from about 1 to about 2 atmospheres.

10. The spark gap switch system of claim 4 wherein the easily condensed gas is condensed at a temperature of from about 10° to about 200° C.

11. A spark gap switch system capable of operating at a high pulse rate comprising:
(a) a spark gap switch comprising:
(1) an insulated housing;
(2) a purging gas entrance port in a wall of said housing;
(3) a gas exit port in another wall of said housing; and
(4) a pair of spaced apart electrodes each having one end thereof within said housing and defining a spark gap therebetween;
(b) an easily condensable low molecular weight insulating gas selected from the class consisting of steam, ammonia, and steam-ammonia mixtures flowing through said switch housing from said entrance port to said exit port to purge hot gases from said housing;
(c) condensing means for condensing said insulating gas after it exits from said housing;
(d) pump means for recirculating said condensed insulating gas as a liquid back to said housing; and
(e) vaporizing means to vaporize at least a portion of said condensed insulating gas back into a vapor prior to flowing said insulating gas back into said housing.

12. The spark gap switch system of claim 11 wherein said easily condensable low molecular weight gas comprises steam and said steam is formed by vaporization at at a temperature of from about 10° to about 150° C.

13. A spark gap switch system capable of operating at a high pulse rate comprising:
(a) an insulated switch housing having a purging gas entrance port and a gas exit port;
(b) a pair of spaced apart electrodes each having one end thereof within a first bore formed in said housing and defining a spark gap therebetween;
(c) a flow of steam passing through said switch housing from said entrance port to said exit port to purge hot gases from said housing;
(d) condensing means for condensing said steam after it exits from said housing;
(e) pump means for recirculating said condensed steam as a liquid back to said housing; and
(f) vaporizing means to vaporize at least a portion of said liquid back into steam prior to flowing said steam back into said housing.

14. A method of operating a spark gap switch system capable of operating at a high pulse rate which comprises:
(a) flowing an easily condensable insulating gas through a spark gap switch comprising:
(1) an insulated housing;
(2) a purging gas entrance port in a wall of said housing;
(3) a gas exit port in another wall of said housing; and (4) a pair of spaced apart electrodes each having one end thereof within said housing and defining a spark gap therebetween;

to purge hot gases from said spark gap switch;

(b) condensing said easily condensable insulating gas into a liquid by passing it through condensing means after it exits from said switch;

(c) recirculating said condensed insulating gas as a liquid back to said housing through pump means; and (d) vaporizing at least a portion of said liquid prior to flowing said insulating gas back into said housing.

15. The method of claim 14 which further includes maintaining the pressure in the system at from about 1 to about 10 atmospheres.

16. The method of claim 15 which further includes maintaining the pressure in the system at from about 1 to about 5 atmospheres.

17. The method of claim 16 which further includes maintaining the pressure in the system at from about 1 to about 2 atmospheres.

18. The method of claim 14 which further includes heating said vaporized liquid to a temperature of from about 10° to about 200° C.

19. The method of claim 14 which further includes heating said vaporized liquid to a temperature of from about 10° to about 150° C.

20. The method of claim 14 wherein said step of flowing an easily condensable insulating gas through said spark gap further includes flowing a low molecular weight gas through said spark gap.

21. A high pulse rate spark gap switch apparatus of the type energized by an external energy source to change the state of the gas within the switch from non-conducting to conducting which comprises:

(a) a spark gap switch comprising:

(1) an insulated housing;

(2) a pair of spaced apart electrodes each having one end within said housing and defining a spark gap therebetween;

(3) a gas entrance port in a wall of said housing and positioned to permit an easily condensable insulating gas entering said port to flow through said spark gap between said electrodes to thereby purge gas from said gap; and (4) a gas exit port spaced from said gas entrance port to permit exit from said housing of gases purged from said gap between said electrodes;

(b) an easily condensable insulating gas flowing through said switch housing from said entrance port to said exit port to purge gases from said switch housing, including gases present in said gap between said electrodes;

(c) condensing means for condensing said insulating gas after it exits from said switch housing;

(d) pump means for recirculating said condensed insulating gas as a liquid back to said switch housing; and (e) vaporizing means to vaporize at least a portion of said condensed insulating gas back into a vapor prior to flowing said insulating gas back into said switch housing.

* * * * *